US007222391B2

(12) United States Patent
Fan

(10) Patent No.: US 7,222,391 B2
(45) Date of Patent: May 29, 2007

(54) WIRELESS BLACKBOARD ERASER AND DUST COLLECTOR

(76) Inventor: Chen-Lang Fan, 2Fl, No. 13, Alley 14, Lane 212, Guoguang St., Junghe City, Taipei Hsien (TW)

( * ) Notice: Subject to any disclaimer, the term of this patent is extended or adjusted under 35 U.S.C. 154(b) by 632 days.

(21) Appl. No.: 10/420,871

(22) Filed: Apr. 23, 2003

(65) Prior Publication Data

US 2004/0211022 A1 Oct. 28, 2004

(51) Int. Cl.
*A47L 5/24* (2006.01)

(52) U.S. Cl. ..... 15/344; 15/403

(58) Field of Classification Search ..... 15/3, 15/22.1, 424, 27, 347, 344, 403, 244.1, 346, 15/221; 434/423
See application file for complete search history.

(56) References Cited

U.S. PATENT DOCUMENTS 3,728,847 A * 4/1973 Howard et al. ..... 55/371
4,204,298 A * 5/1980 Handa et al. ..... 15/344
4,941,225 A * 7/1990 Liao ..... 15/98
4,955,996 A * 9/1990 Edwards et al. ..... 55/302
5,655,253 A * 8/1997 Nevin et al. ..... 15/310
6,488,731 B2 * 12/2002 Schultheiss et al. ..... 55/486
6,564,415 B1 * 5/2003 Katakura et al. ..... 15/104.94
6,772,472 B2 * 8/2004 Wang ..... 15/344
2003/0037404 A1 * 2/2003 Wu et al. ..... 15/344

* cited by examiner

*Primary Examiner*—David Redding
(74) *Attorney, Agent, or Firm*—Rabin & Berdo, P.C.

(57) ABSTRACT

The present invention provides a battery-operated blackboard eraser and dust collector, which is composed of a shell body, an air blower, and an erasing plate set. The air blower is installed inside the shell body and the erasing plate set is disposed under the shell body. The eraser shell consists of a piece of erasing cloth, a piece of air-permeable sponge, a base plate, and a group of air-permeable papers.

7 Claims, 5 Drawing Sheets

WIRELESS BLACKBOARD ERASER AND DUST COLLECTOR

FIELD OF THE INVENTION

The present invention provides a kind of wireless blackboard eraser and dust collector machine comprising an air blower and a shell. When using the machine to erase blackboards or the like, the air blower inside the shell will suck in the dust particles, so as to prevent them from flying away.

BACKGROUND OF THE INVENTION

Generally speaking, most teaching places are equipped with backboard or whiteboard for the teacher to write down the text or to make explanations. In some occasions, pencils or whiteboard-writing pens are used for writing on whiteboards. But pencils and whiteboard-writing pens often contain volatilizable and poisonous organic solvents, which do much harm to human bodies. In other places chalks are used. The chalk dusts adhere on the blackboard, and with the motion of the eraser, drop down and fly away all around, making the ambient space filled with chalk dusts. This is also very harmful to the teachers and learners, especially, the young children. Since using chalks and common blackboard erasers causes lots of flying dusts, it is not good to the health and inconvenient for teaching, and is often criticized by the teachers.

SUMMARY OF THE INVENTION

The present invention installs an air blower inside the shell body and an erasing plate set, which is permeable for the air but not for the dusts, at the bottom of the shell, thus finally completes a blackboard eraser and dust collector. When using the machine to erase blackboards or the like, the air blower inside the shell will suck in the dust particles, so as to prevent them from flying away and avoid the harm to human bodies.

BRIEF DESCRIPTION OF THE DRAWINGS

Drawings

Figure 1:
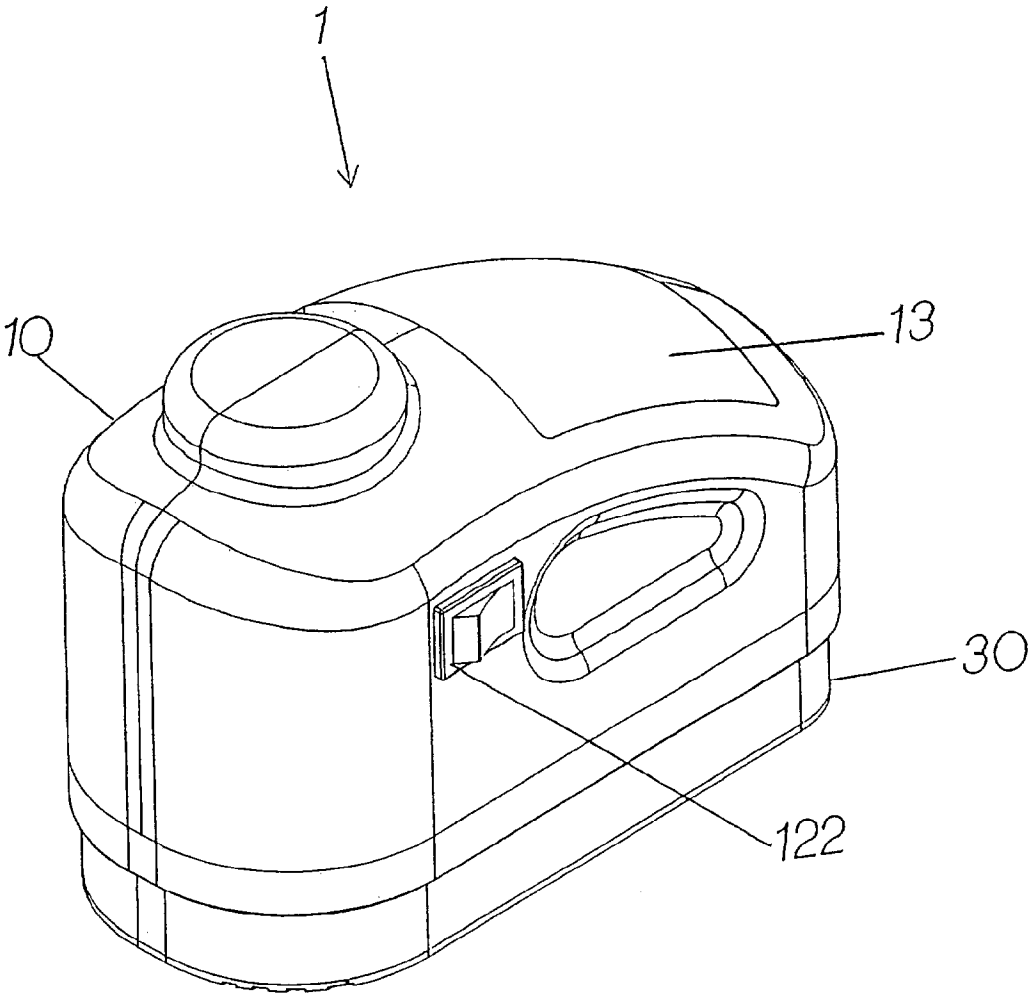
FIG. 1: Space diagram of the present invention

CODE NUMBERS (1) Blackboard eraser and dust collector
(10) Shell body
(11) Left shell
(112) Battery
(12) Right shell
(122) Power switch
(111) Battery seat
(121) Opening
(13) Battery cover
(20) Air blower
(21) Motor
(30) Erasing plate set
(31) Erasing cloth
(32) Air-permeable sponge piece (331) Hole
(341) Air-permeable papers
(2) Blackboard eraser cleaner
(22) Fan
(311) Pore
(33) Base plate
(34) Air-permeable paper group
(342) Frame
(3) Placement groove

DETAILED DESCRIPTION OF THE INVENTION

As shown in FIGS. 1~4, the blackboard eraser and dust collector (1) consists of a shell body (10), an air blower (20), and an erasing plate set (30).

Figure 2:
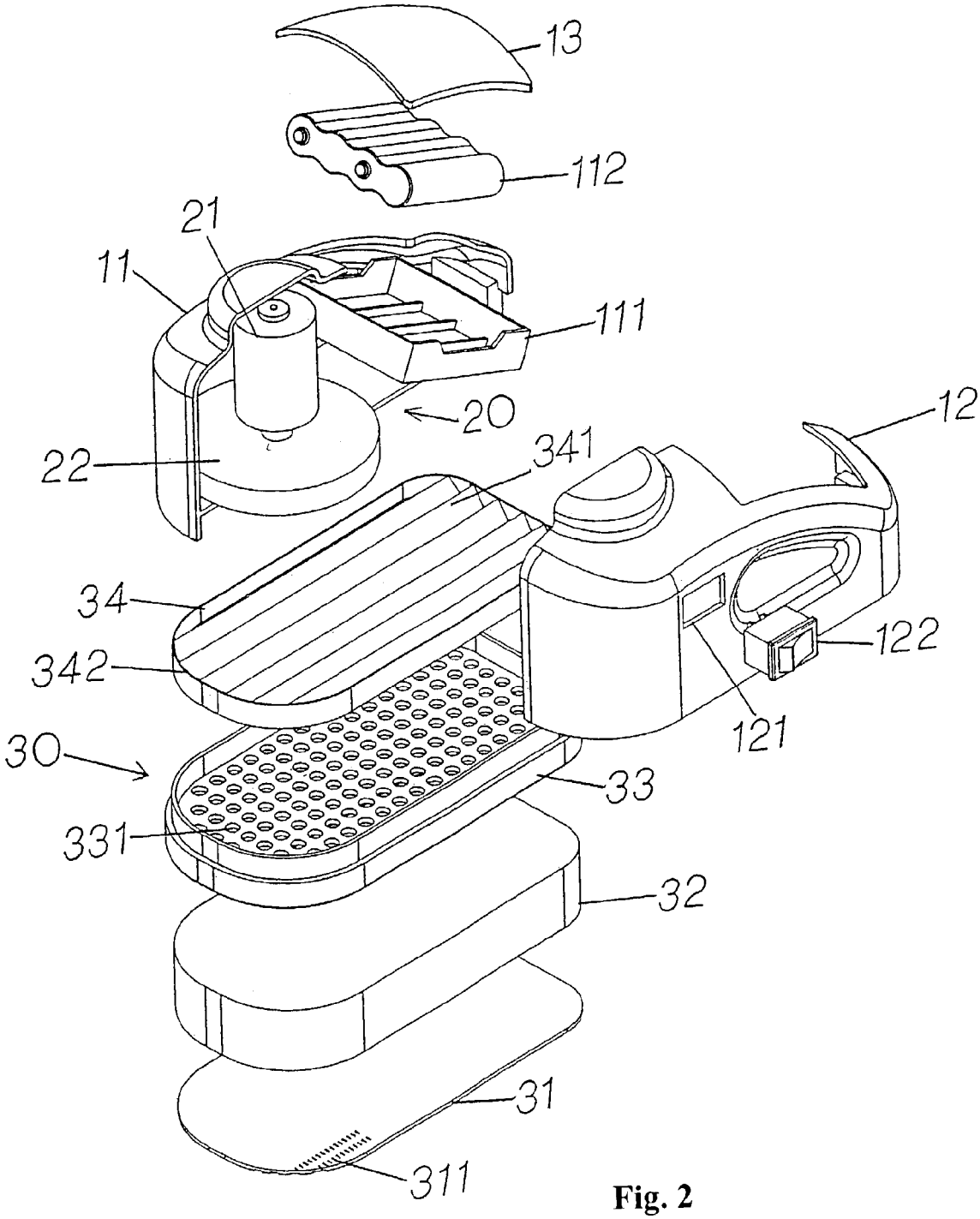
FIG. 2: Breakdown drawing of the present invention
Figure 3:
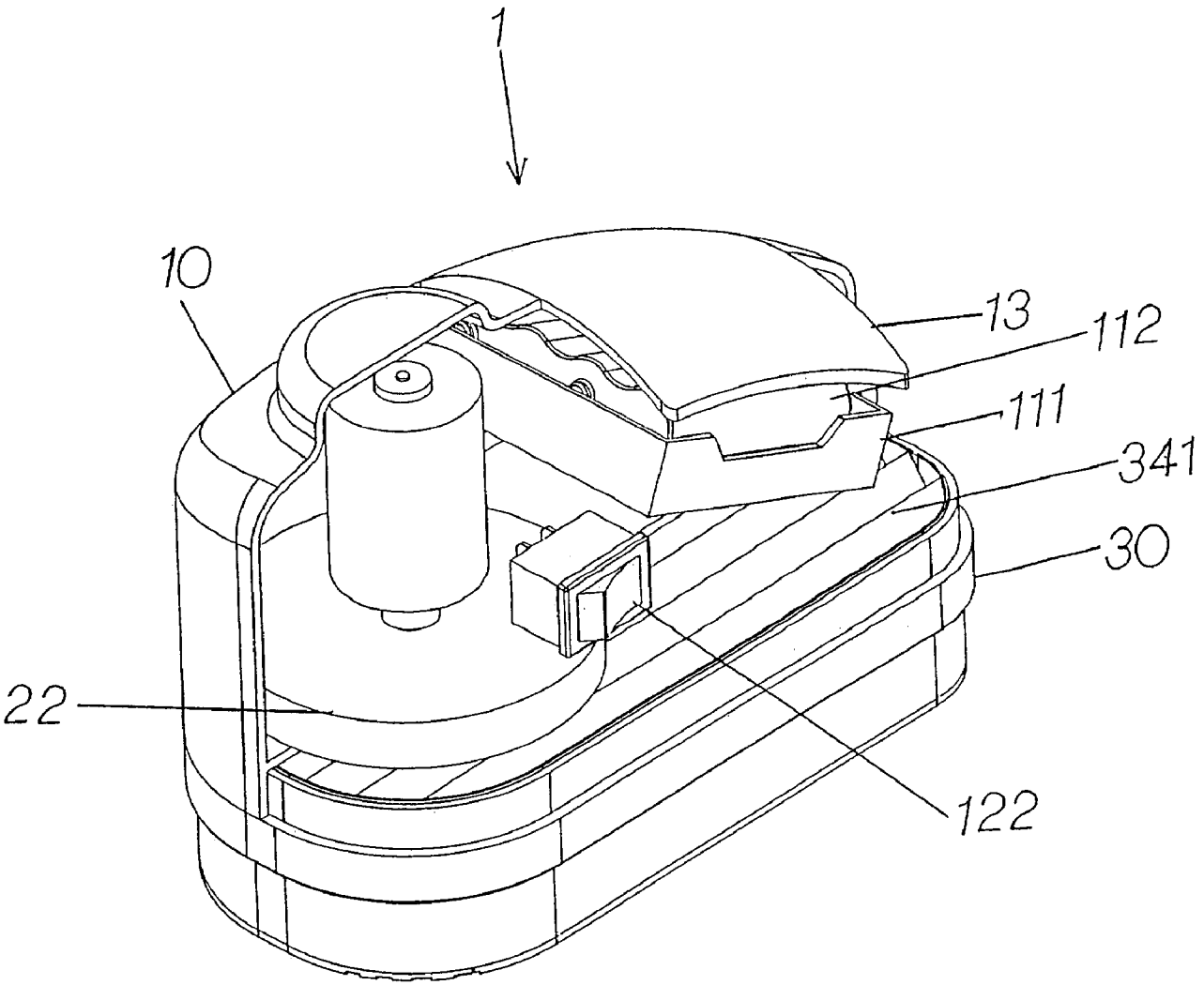
FIG. 3: Spatial sectional drawing of the present invention

And as shown in FIGS. 2 and 3, the shell body (10) is divided into the left shell (11) and the right shell (12), which are in symmetry with each other. Inside the left shell (11) there is a battery seat (111) for placing battery (112), and on the exterior surface of the right shell (12) is an opening (121) for installing a power switch (122) here.

The air blower (20) is composed of a motor (21) and a fan (22).

The erasing plate set (30) is composed of a piece of erasing cloth (31), a piece of air-permeable sponge (32), a base plate (33), and an air-permeable paper group (34), which are overlapped in sequence.

On the erasing cloth (31) there are many regular small pores (311). The sponge (32) is permeable for the air but not for the dusts. On the base plate (33) there are multiple irregular holes (331) for air to flow. And the air-permeable paper group is composed of the air-permeable papers (341), which are folded into a form of stereo saw tooth, and a frame (342) installed around.

Figure 4:
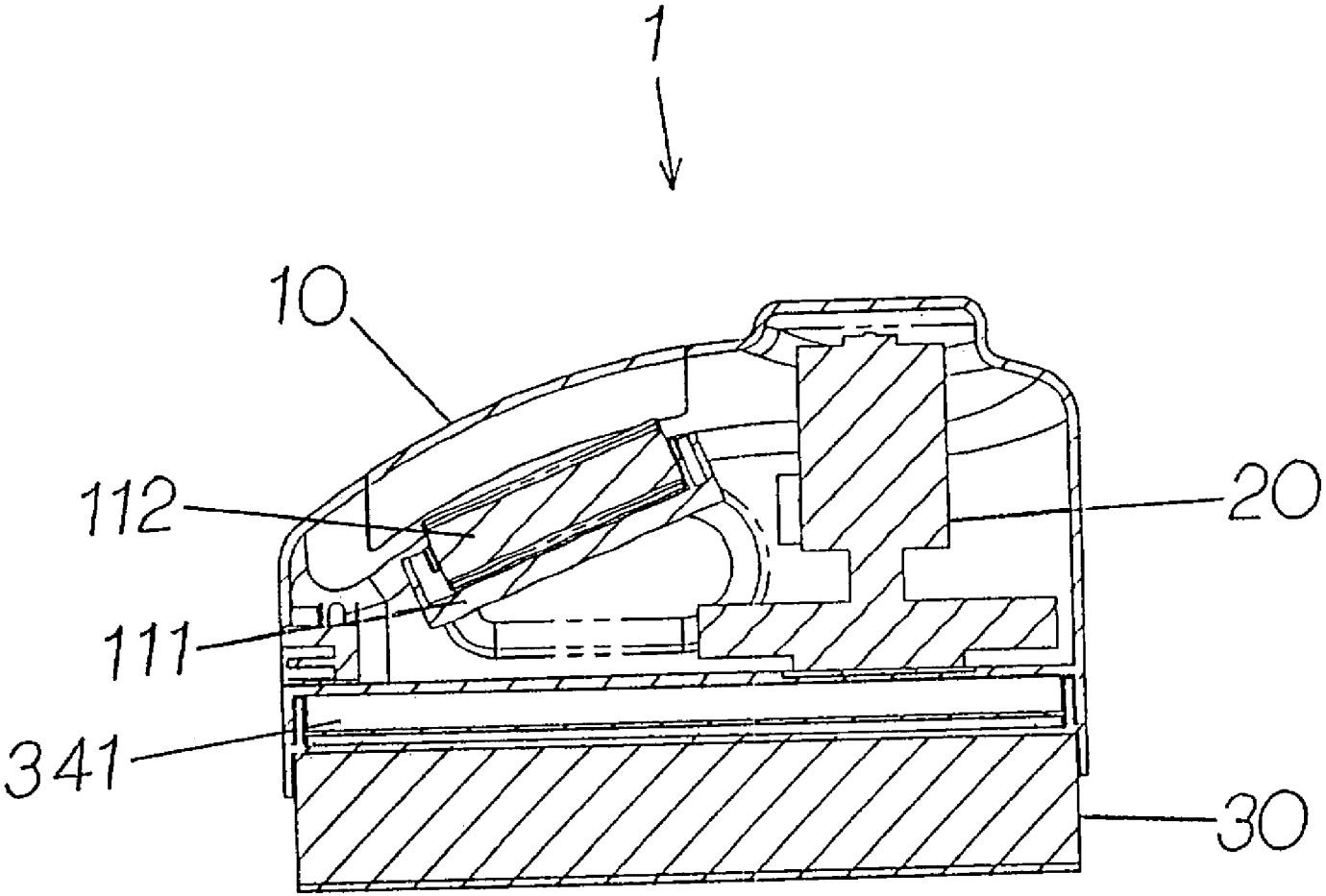
FIG. 4: Sectional side view of the present invention

Please refer to FIGS. 2~4. Firstly, install the air blower (20) inside the left shell (11), and place the battery (112) in the battery seat (111). Then, install the right shell (12) together with the left shell (11), and place the battery cover (13) on the back of the left and right shells (11) and (12). Secondly, plaster the erasing cloth (31) onto the air-permeable sponge piece (32), and attach the two onto one surface of the base plate (33); and then place the air-permeable paper group (34) on the other surface of the base plate (33), so as to finish the whole erasing plate set (30). Finally, install the erasing plate set (30) under the shell body (10), thus completely finish the blackboard eraser and dust collector (1).

As shown in FIGS. 3 and 4, when using the blackboard eraser and dust collector (1) to erase blackboard or the like, the user turns on the power switch (122), then the air blower (20) inside the blackboard eraser and dust collector (1) makes suction actions. Sucked in by the air blower (20), the dusts produced in the process of erasing will enter the air-permeable sponge piece (32) through the small pores (311) on the erasing cloth (31) of the erasing plate set (30). Among the dusts, the larger particles will remain inside the air-permeable sponge piece (32), and the smaller ones will directly enter the air-permeable papers (341) of the air-permeable paper group (34).

Figure 5:
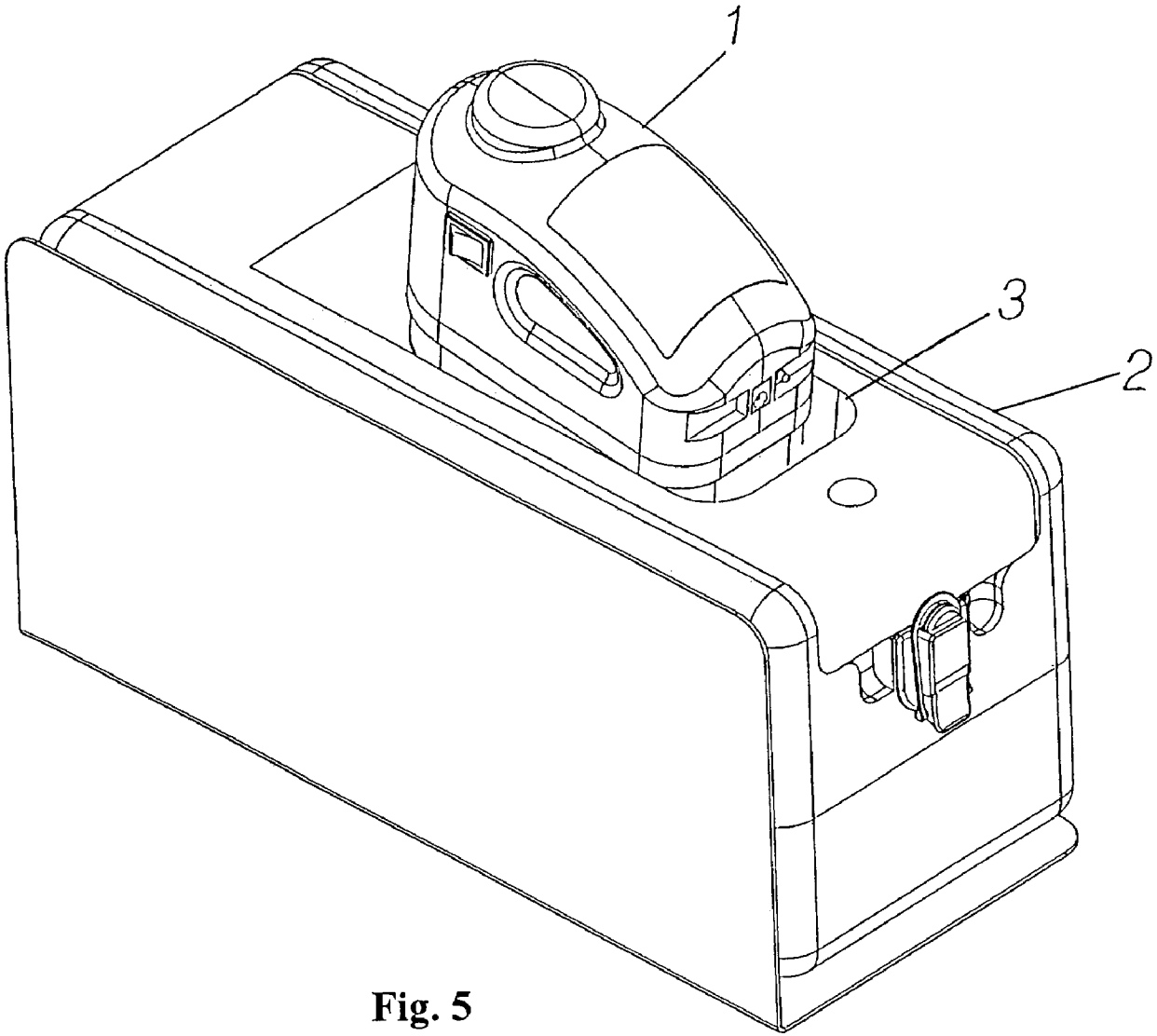
FIG. 5: Drawing of cleaning the present invention

As shown in FIG. 5, after the blackboard eraser and dust collector (1) finishes the work, some residual dusts will remain on the surface of the erasing cloth (31) and the sucked dusts will accumulate on the air-permeable sponge piece (32) and the air-permeable papers (341). At that time, just move the blackboard eraser and dust collector (1) to the placement groove (3) of the blackboard eraser cleaner (2), and then the cleaner (2) will suck the dusts on the surface of the erasing cloth (31), the air-permeable sponge piece (32), and the air-permeable papers (341) into the interior of the cleaner (2), so as to clean the blackboard eraser and dust collector (1).

What is claimed is:

1. An electric blackboard eraser and dust collector, comprising;

a shell body, an air blower, and an erasing plate set, wherein the air blower is installed inside the shell body and the erasing plate set under the shell body, and wherein the erasing plate set comprises a piece of erasing cloth, a piece of air-permeable sponge, a base plate having holes therein, and at least one piece of air-permeable paper, the piece of erasing cloth and the piece of air-permeable sponge being disposed on an outer side of the base plate and the at least one piece of air-permeable paper being disposed on an inner side of the base plate.

2. The electric blackboard eraser and dust collector of claim 1, wherein the piece of erasing cloth has many small pores and the at least one piece of air-permeable paper has a saw teeth form.

3. The electric blackboard eraser and dust collector of claim 1, in combination with an eraser cleaner device having a recess for receiving the electric eraser and dust collector and sucking out accumulated dust.

4. An electric blackboard eraser and dust collector, comprising:

a shell body;

a base plate mounted on the shell body, the base plate having an inner side and an outer side, the base plate additionally having apertures that extend between the inner and outer sides;

a piece of air-permeable paper disposed at the inner side of the base plate;

an air-permeable resilient member;

a piece of erasing cloth, the air-permeable resilient member and the piece of erasing cloth being disposed at the outer side of the base plate; and an air blower mounted in the shell body to draw air through the piece of erasing cloth, the air-permeable resilient member, the apertures of the base plate, and the piece of air-permeable paper.

5. The electric blackboard eraser and dust collector of claim 4, wherein the air-permeable resilient member is disposed between the piece of erasing cloth and the outer side of the base plate, and is substantially thicker than the piece of erasing cloth.

6. The electric blackboard eraser and dust collector of claim 5, wherein the air-permeable resilient member comprises a sponge.

7. The electric blackboard eraser and dust collector of claim 4, in combination with an eraser cleaner device having a recess for receiving the electric eraser and dust collector and sucking out accumulated dust.

* * * * *